United States Patent [19]

Silverman

[11] Patent Number: 4,773,485

[45] Date of Patent: Sep. 27, 1988

[54] FIRE EXTINGUISHING SYSTEM FOR COOKSTOVE AND RANGES

[75] Inventor: Robert R. Silverman, Panama City, Fla.

[73] Assignee: Twenty First Century International Fire Equipment and Services, Corporation, Irving, Tex.

[21] Appl. No.: 27,919

[22] Filed: Mar. 19, 1987

[51] Int. Cl.[4] ..... A62C 3/04

[52] U.S. Cl. ..... 169/65; 126/299 R; 169/54; 169/59; 169/61; 169/42

[58] Field of Search ..... 169/65, 47, 51, 54, 169/57, 59, 60, 61, 19, 42, DIG. 3; 126/299 R

[56] References Cited

U.S. PATENT DOCUMENTS

| | | | |
|---|---|---|---|
| 782,903 | 2/1905 | Morell | 169/54 X |
| 3,448,808 | 6/1969 | Scofield et al. | 169/19 X |
| 3,463,233 | 8/1969 | Haessler | 169/47 |
| 3,584,688 | 6/1971 | Duncan et al. | 169/47 |
| 3,653,443 | 4/1972 | Dockery | 169/61 |
| 3,772,499 | 11/1973 | Fritzsche | 169/65 X |
| 3,824,374 | 7/1974 | Mayher | 169/65 X |
| 4,256,181 | 3/1981 | Searcy | 169/65 |
| 4,356,870 | 11/1982 | Gaylord et al. | 126/299 R |
| 4,580,638 | 4/1986 | Jones et al. | 169/59 X |

*Primary Examiner*—Sherman D. Basinger
*Assistant Examiner*—Paul E. Salmon
*Attorney, Agent, or Firm*—Millen & White

[57] ABSTRACT

A fire extinguishing system for a cookstove or range includes a fire extinguisher mounted above a hood positioned over the cookstove or range. The fire extinguisher is connected to a pair of nozzles within the hood to dispense fire suppressant over the cookstove or range. The fire extinguisher includes an operator normally biased to the operable position but held in the inoperable position by a cable having a plurality of fusible links distributed therein. The cable is held in tension adjacent the inner periphery of the hood. Upon the occurrence of a fire, at least one of the links separates, releasing the cable and allowing the operator to move to the operating position whereby the fire extinguisher releases the fire suppressant.

12 Claims, 3 Drawing Sheets

80
81
32
33
35
29
31
84
77
78
85
37
136
30
38
22
82
46
14
C
52
47
21
16
12
51
49
48
74
71
76
54
41
75
57
56
43
39
18
19
A
59
73
D
70
40
58
69
68
17
61
60
42
63
64
66
11
13
10
B
13
11
11

FIRE EXTINGUISHING SYSTEM FOR COOKSTOVE AND RANGES

This invention relates to an automatically operated fire extinguishing system for electrical/gas cookstoves and ranges, and more particularly concerns such a system associated with a hood over the stove or range.

Automatic fire extinguishing systems known heretofore for use with cookstoves and ranges have generally been concerned with extinguishing a fire due to burning fat in a grease pot or kettle. Generally, the systems were solely concerned with extinguishing the fire. No provision was made for turning off the electrical gas burners of the stove. Frequently, the fire extinguishing system would extinguish the lighted burners of a gas stove which created the very hazardous condition of allowing gas to flow from the burners. This, of course, created a situation in which a residence could fill with gas to dangerous levels and then explode. Or perhaps, on the other hand, the residents could be asphyxiated by gas fumes. If the system is used with an electric stove, the burners could reignite spilled grease and fat once the fire extinguishing foam had dissipated. Moreover, these arrangements had no provision for sounding an alarm or operating a fan to exhaust the smoke and fumes generated by the stove fire.

U.S. Pat. No. 3,653,443 recognized the aforementioned difficulties with the prior art and provided a system for shutting off the stove, operating an alarm and exhausting fumes. To the knowledge of the instant inventor, the concepts set forth in U.S. Pat. No. 3,653,443 have never been commercialized. The particular arrangement set forth in this patent has apparently not been commercialized because of the expense and difficulty in combining the concept of this patent with existing hood designs. In other words, the particular structure disclosed in this patent is not readily retrofittable to existing hoods.

The prior art discloses numerous arrangements for automatically extinguishing stove fires. U.S. Pat. No. 4,256,181 discloses a fire extinguisher in combination with a hood. However, this patent requires a tube for conducting heat from the stove to a mechanism for operating the fire extinguisher. The operating mechanism includes a flammable fuel which generates heat in a cabinet above the stove making the operating system itself a fire hazard. The foam from the extinguisher is dispensed on the stove rather than in the cabinet and therefore could not extinguish a fire caused in the cabinet by the operating mechanism.

Other patents, such as U.S. Pat. Nos. 4,580,638; 3,584,688 and 3,448,808 and 3,824,374 each disclose arrangements of cables and fusible links. However, these arrangements are not configured in a fashion which is readily adaptable to retrofitting in existing stove hoods or existing stove configurations.

SUMMARY OF THE INVENTION

It is an object of the instant invention to provide a new and improved system for extinguishing fires on cookstoves and ranges wherein the system is automatic and is readily retrofittable to existing stove hoods.

Upon further study of the specification and appended claims, further objects and advantages of this invention will become apparent to those skilled in the art.

In view of the aforementioned object, and other objects, the instant invention contemplates a fire extinguishing system for cookstoves and ranges wherein the fire extinguishing system is mounted within and adjacent to a hood which is positioned over the stove or range. The system comprises a fire extinguisher having an operator biased to a first position in which the fire extinguisher releases a fire extinguishing substance from a second position in which the fire extinguisher retains the fire extinguishing substance. A cable is attached to the operator of the fire extinguisher for holding the operator in the second position and means are provided for training the cable around a substantial portion of the inner periphery of the hood and for anchoring the distal end of the cable within the hood. A plurality of fusible links are disposed within the cable and distributed around the hood wherein, when there is a fire on the stove or range, at least one of the fusible links will separate, releasing the cable to allow the operator to move from the second position to the first position and thereby release the fire extinguishing substance onto the stove top.

Connected to the fire extinguisher is a detector which detects when the fire extinguisher begins to operate. Connected to the detector are various emergency switches or operators which turn off electricity or gas to the stove, and if desired operate a fan in the hood to exhaust fumes from the fire and sound an alarm in the house and/or at a remote location such as a fire station.

DETAILED DESCRIPTION

Figure 1:
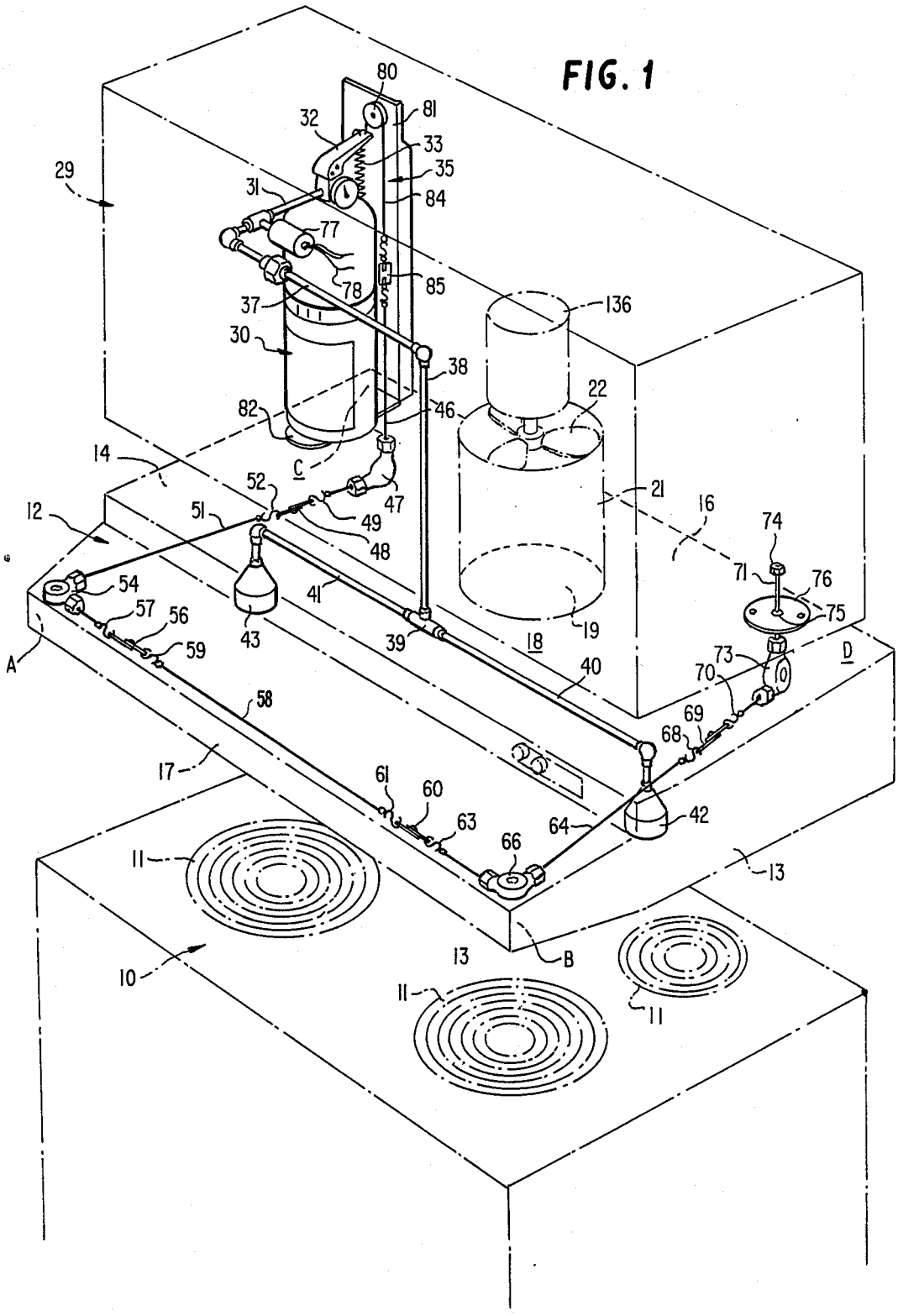
FIG. 1 is a perspective view of a fire extinguishing system configured in accordance with the principles of the instant invention.

Referring now to FIG. 1 there is shown a stove or range, designated generally by the numeral 10, which includes a plurality of burners 11. The stove or range 10 is preferably of the type used in a private residence. Positioned over the stove or range 10 is a conventional hood, designated generally by the numeral 12. The hood 12 has a pair of side walls 13 and 14, a rear wall 16, a front wall 17 and a top surface 18 and has corresponding first and second front corners A and B and first and second rear corners C and D. The hood 12 has an opening 19, preferably through the top surface 18 thereof which is attached to a duct 21 having an exhaust fan 22 therein for forcibly evacuating fumes and vapor which collect in the hood during cooking on the stove 10.

In accordance with the principles of the instant invention, a fire extinguisher designated generally by the numeral 30, (preferably international Fire equipment PNA30340, fire extinguisher model 2861) is positioned adjacent to, and perhaps preferably over, the hood 12 in a cabinet 29 schematically illustrated by a broken line. The fire extinguisher 30 is a conventional extinguisher and may dispense either a liquid or dry fire suppressant material. In accordance with the preferred embodiment of the invention, the material dispensed is dry. The fire extinguisher 30 has an outlet 31 through which the fire suppressant material flows under pressure upon moving operating lever 32 downwardly. In accordance with the principles of the instant invention, the operating lever 32 is attached to a coil spring 33 which is under tension. The coil spring 33 biases the operating lever 32 downwardly so as to eject fire suppressant material through the outlet 31. As will be explained more fully hereinafter, the operating lever 32 is held in a first, non-operating position by tension on a cable designated generally by numeral 35. Upon release of the tension on the cable 35, the operating lever 32 moves to a second position as the spring 33 contracts and the material moves out through the nozzle 31 through a horizontal pipe 37, down a vertical pipe 38 inside the hood 12 to a T-joint 39. The T-joint 39 is connected to a pair of horizontal pipes 40 and 41 extending toward the side walls 13 and 14 of the hood respectively. At the end of each of the pipes 40 and 41 are nozzles 42 and 43, respectively, through which the fire suppressant material expands and covers the top of the stove or range 10 putting out any fire thereon. Preferably, the fire suppressant material is a non toxic dry material such as dry nitrogen which smothers the fire by denying oxygen to whatever material is burning.

The cable 35 which holds the operating handle 32 in the first position against the bias of spring 33 is looped over a first pulley 80 journaled on a mounting bracket 81 which supports the fire extinguisher 30 on a shelf 82. The bracket 81 is rigidly attached to a wall of cabinet 29 or some other surface which is in fixed relation to the hood 12. The cable 35 has a first section 84 which is attached to a turnbuckle 85 that allows adjustment of the cable. A second section of the cable 46 is attached to the other end of the turnbuckle 85 and is trained around a pulley 47 that is secured to the underside of the top 18 of the hood 12 which has a hole therethrough through which the second section 46 of the cable passes. The second section of the cable 46 exits from the pulley 47 at a right angle to the direction in which it entered the pulley and extends a distance horizontally within the hood 12 adjacent wall 14. A first fusible link 48 is attached to the second length of cable 46 by an S-hook 49. The other end of the fusible link 48 is attached to a third length of cable 51 by a second S-hook 52. The third length of cable 51 is trained around a second pulley 54 in the first front corner A of the hood and emerges adjacent the front wall 17 of the hood where it is connected to a second fusible link 56 by an S-hook 57. The second fusible link 56 is connected to a fourth length of cable 58 by an S-hook 59 which extends behind the front wall 17 a distance to a fourth heat fusible link 60 to which it is connected by an S-hook 61. A fifth length of cable 64 is attached by an S-hook 63 to the fusible link 60 and extends around a third pulley 66 so as to extend along behind the side wall 13 of the hood 12. The fifth cable 64 is connected by S-hook 68 to a fourth fusible length 69 and by S-hook 70 to a sixth length of cable 71. The sixth length of cable 71 is trained around a fourth pulley 73 and emerges through the top wall 18 of the hood 12 where it is secured to a stop 74. The stop 74 prevents the fifth cable section 71 from sliding through a hole 75, a flange 76 which is positioned on the top surface of the top 18 of hood 12.

The fire extinguishing system in accordance with principles of the instant invention may be installed by the average homeowner using existing tools. First, the fire extinguisher 30 is placed above the hood 12, preferably in a cabinet 29. The piping for carrying fire suppressant is then passed through the bottom of the cabinet 29 and the top 18 of the hood 12. The T 39 is connected to the vertical pipe 38 and the horizontally extending pipes 40 and 41 are screwed into the T. The horizontally extending pipes may be stiff enough to be cantilevered from the T 39 or may perhaps be supported at their ends adjacent the nozzles 42 and 43. The nozzles 42 and 43 are then screwed into elbows attached to the ends of the horizontal pipes 40 and 41. The cable 35 is then strung through the system, sequentially attaching the fusible links 48, 56, 60, and 69 with the various S-hooks. The portion of the fifth cable section 71 which extends through plate 75 is then secured by fixing the stop 74 to the end of the fifth cable section. The turnbuckle 44 is then shortened to take up any slack in the cable 35 and to tension the cable somewhat. Spring 33 is then anchored to the bracket 81 at one end and stretched to reach and overlie the handle 32 so as to bias the handle 32 in a downward direction toward the second position. However, the tension in cable 35 keeps the handle 32 in the first position. The fire extinguishing system is now set to automatically operate upon the occurrence of a fire on the stove 10.

When there is a fire on the stove, the fire will melt the solder or other material fusing the halves of at least one of the links 48, 56, 60 and 69 together. As soon as one of the links separates due to the heat of the fire, the cable 35 will no longer be tensioned and spring 33 will move the handle 32 from its first position to its second position causing the extinguisher 30 to release the fire suppressant chemicals therein. The extinguisher 30 will continue to operate until the fire suppressant chemical is exhausted.

If there is no one present when the fire occurs, to turn off the burners 11 on the stove 10, the dangerous condition which caused the fire in the first place can resume without there being any further provision for putting out a subsequent fire. Discharging the fire extinguisher 30 does not automatically turn off the source of heat which started the fire initially. The burners 11, if they are electrical burners, will continue to generate heat. After a while, the grease which remains on the stove 10 will again reignite. Since the fire extinguishing system is a one-shot arrangement, the subsequent fire will not be extinguished. If the burners 11 are gas burners, the fire suppressant will extinguish the burners, however, the gas for energizing the burners will continue to enter the stove and pour into the room without burning. This accumulation of gas could result in a subsequent explosion or could asphyxiate people in the hour or apartment where the stove 10 is located.

Figure 2:
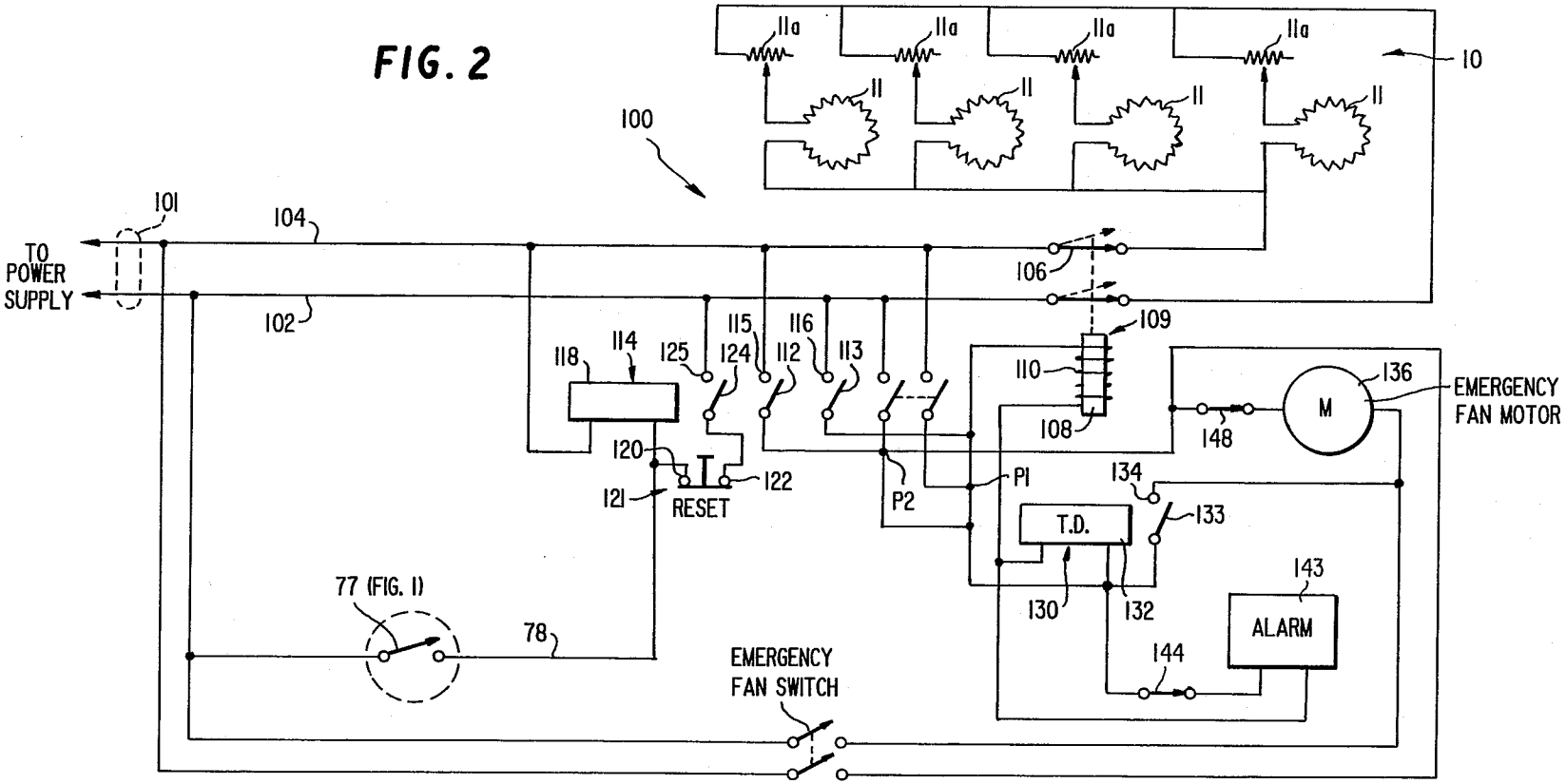
FIG. 2 is a circuit diagram showing the system of the instant invention used to interrupt power to an electric stove as well as to sound an alarm and start an exhaust fan.
Figure 3:
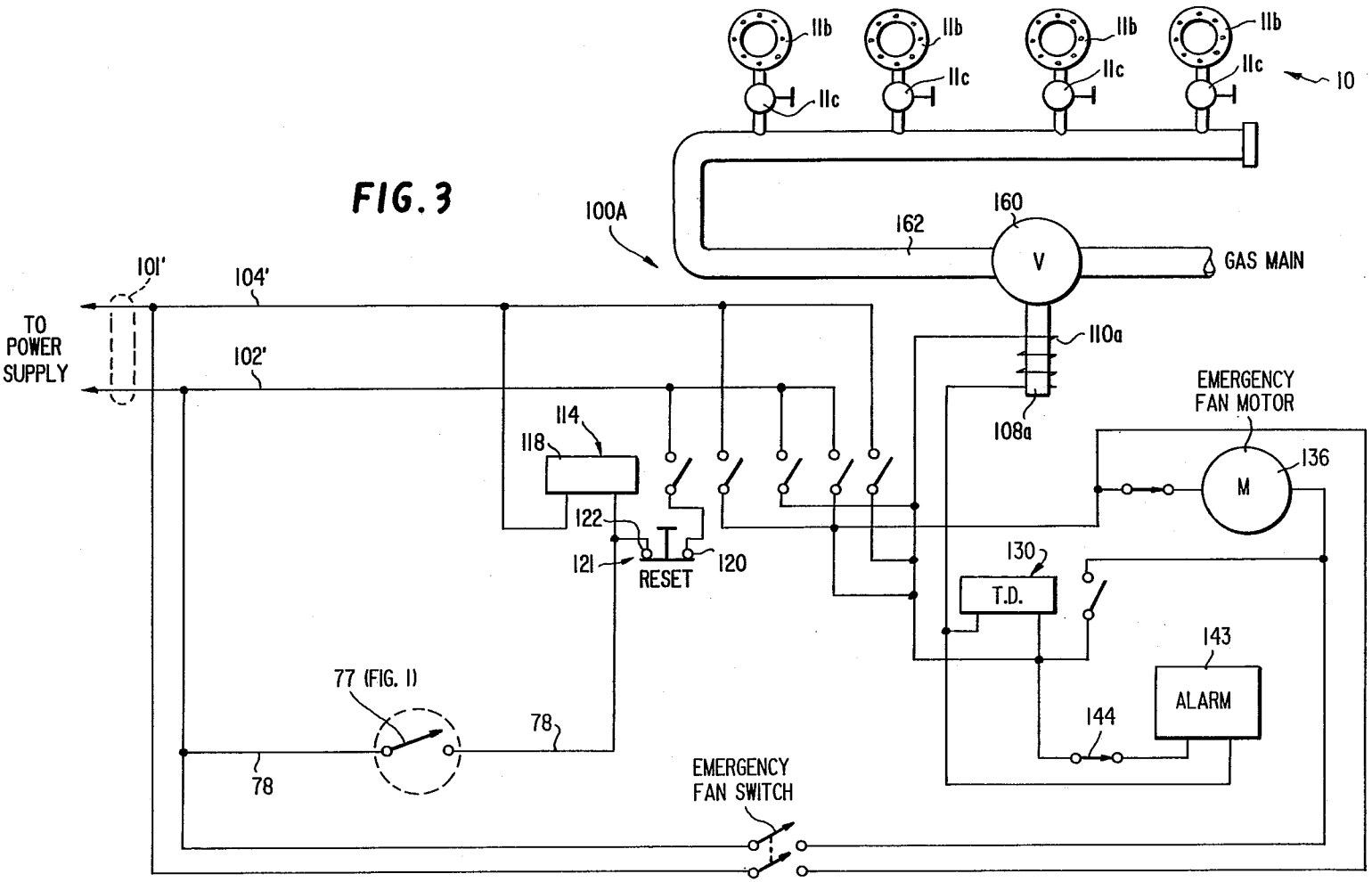
FIG. 3 is a circuit diagram showing a circuit for interrupting the flow of gas to a gas burner while sounding an alarm and turning on an exhaust fan.

In order to prevent the occurrence of these situations, the pipe 31 leading from the fire extinguisher is equipped with a pressure switch 77 which detects when the extinguisher 30 discharges. Pressure switch 77 is connected by leads 78 to either the circuit of FIG. 2 or the circuit of FIG. 3. The circuits of FIG. 2 and FIG. 3 are substantially similar to the circuits disclosed in U.S. Pat. No. 3,653,443, incorporated herein by reference, and not only shut off the power supply (gas or electric current) to the burners 11, but sound an alarm as well as operate an exhaust fan.

Referring first to FIG. 2, there is shown schematically a control circuit 100 to which the pressure switch 77 is connected via lines 78. Power line 101 for the stove 10 includes wires 102, 104 connected via a double pole switch 106 to the burners 11 which are in series respectively with rheostats 11A for controlling the stove. The double pole switch 106 is normally closed but can be opened by a plunger 108 of a solenoid operated breaker 109. The solenoid 110 of the circuit breaker is connected at opposite ends of contacts 112, 113 of a relay 114. Contacts 112 and 113 are normally open with respect to contacts 115, 116. Contacts 115 and 116 are connected to wires 104 and 102, respectively. Coil 118 of relay 114 is connected to wire 104 and to terminal 120 of a normally closed reset switch 121. Switch 121 is a pushbutton operated switch. Terminal 122 of the switch 121 is connected to contact 124 of a relay 114. This contact is normally open with respect to a contact 125 which is connected to the power line 102.

A time delay relay 130 has a coil 132 connected to relay contacts 112 and 113. The relay 130 has a contact 133 connected to relay contact 112. The contact 134 is connected to one terminal of the fan motor 136 which operates the fan 22 shown in FIG. 1. The other terminal of the fan motor 136 is connected via a switch 135 to relay contact 113. The terminals of the fan motor 136 are also connected via wires 140 and double pole switch 141 to power wires 102 and 104. An audible alarm 143 is connected at one end via switch 144 to relay contact 113.

In operation of the system including the circuit 100, the relay 118 is normally deenergized. Switch 106 is closed. This enables operation of the burners 11 in a normal way without interference by the fire extinguishing system. If a fire occurs on the stove or range 10 the fire extinguisher 30 will discharge, pressurizing the switch 77 which applies power to the relay coil 118 so as to close relay coil and hold it closed via its holding circuit including closed contacts 124 and 125 and the reset switch 121. Thus even if the pressure within pressure switch 77 subsides, relay 114 will remain energized. Closure of the contacts of relay 114 also actuates alarm 143 and energizes relay 130. Relay 130 has a time delay of five to ten minutes to allow time for the fire extinguisher 30 to extinguish the fire. Relay 130 then closes and the fan motor 136 is turned on to operate exhaust fan 22 and to clear the kitchen of smoke and fumes.

If desired, one may omit the alarm 143 and the alarm can be turned off, if it is automatically operated, by opening switch 144.

It is also possible to omit an exhaust fan 22 in which case the motor 136 and relay 130 can be deleted. Where the fan is provided, it is possible to turn the fan on manually at any time by closing the fan switch 148 if the fan motor 136 operates automatically, switch 148 can be opened manually to stop the fan or switch 148 can be left on to deactivate the fan motor. Once the relay 114 is energized by discharge of the fire extinguisher 30, the switch 106 is opened by circuit breaker 109 and remains open. The fan and alarm also stay on. The system can be deactivated entirely by momentarily pressing the reset switch 121 to open it. This will open the holding circuit for relay 114.

The circuit 100A shown in FIG. 3 is similar to circuit 100 except that the solenoid operated valve 160 is provided for opening a gas main 162 automatically in case of a fire in the range where gas burners 11B are controlled by hand valves 11C. All parts mounted in an adjacent hood 12 shown in FIG. 1 apply equally well to the circuit 100A, so that parts of the circuit 100A corresponding to those circuit 100 are identically numbered. Power to operate the system is provided via power lines 102' and 104'.

Valve 160 has a solenoid 110A which actuates plunger 108A of the valve. The solenoid is energized by operation of relay 114 in the same manner as described in FIG. 2.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A system for extinguishing a residential stove top fire which may occur on a residential stove range that has burners and is used in conjunction with a hood, cabinet and means for energizing the burners, the system comprising in combination:

an enclosure defined by the hood, the enclosure having a top wall, first and second side walls, a front wall and a rear wall; the walls joining at first and second front corners and first and second rear corners, the cabinet being positioned over and in juxtaposition with the hood;

a pair of nozzles positioned within the hood, and facing the burners of the stove range, the nozzles being in juxtaposition with the side walls of the hood;

a fire extinguisher positioned in the cabinet and connected to the nozzles via a pipe which passes through the wall of the cabinet and the top of the hood and has branches to the nozzles for dispensing fire suppressant material through the nozzles;

means for operating the fire extinguisher and means for biasing the operating means to a first position which causes the fire extinguisher to discharge the fire suppressant;

means for holding the operating means in a second position in opposition to the biasing means, wherein when the operating means is in the second position, the fire extinguisher is prevented from discharging;

the means for holding the operating means in the second position including a cable means segmented in a plurality of sections, each section being connected to adjacent sections by fusible links, the cable means including means for adjusting the length of the cable means;

pulley means positioned inside of the hood, the pulley means including a first pulley adjacent the first rear corner thereof, a second pulley adjacent the front wall and juxtaposed with the first front corner thereof, a third pulley adjacent the front wall and juxtaposed with a second front corner thereof and a fourth pulley adjacent the second rear corner thereof; the cable means being trained around the pulleys;

means for anchoring one end the cable means to the hood in a position adjacent to the fourth pulley; whereby the cable means is held in tension substantially around and in alignment with the inner periphery of the hood to hold the operating means in a second position, and whereby when there is a fire on the stove at least one of the fusible links separates, releasing tension on the cable and allowing the operator to move from the second position to the first position under a force exerted by the biasing means; and a pressure sensor connected to the outlet of the fire extinguisher for detecting release of the fire suppressant and thus the occurrence of a fire, the pressure sensor being connected to a circuit, which circuit includes means for interrupting energy flowing from the energizing means to the burners of the stove.

2. The system of claim 1, wherein the means for anchoring the cable means to the hood is positioned outside of the hood on top of the hood.

3. The system of claim 2, wherein the branches to the nozzles are located within the hood enclosure and the pipe is within the cabinet.

4. The system of claim 2, wherein the means for adjusting the length of the cable is a turn-buckle positioned adjacent the fire extinguisher.

5. The system of claim 4, wherein the fire extinguisher is in the form of a canister which is oriented vertically within the cabinet.

6. The system of claim 5, wherein the pipes are rigid.

7. The system of claim 2, wherein the plurality of sections comprising the cable means are joined to one another by S-hooks so that the cable means may be rapidly deployed within the hood and cabinet with minimal skill.

8. The system of claim 1, wherein the circuit also includes an alarm for indicating an occurrence of a fire.

9. The system of claim 1, wherein the fire suppressant material is a dry suppressant.

10. The system of claim 1, wherein the fire suppressant material is a liquid suppressant.

11. The system of claim 1, wherein the burners are electric burners and the energizing means is electric current.

12. The system of claim 1, wherein the burners are gas burners and the energizing means is gas delivered through the gas line.

* * * * *